US010011467B1

(12) United States Patent
Perry et al.

(10) Patent No.: US 10,011,467 B1
(45) Date of Patent: Jul. 3, 2018

(54) FIXATION SYSTEM FOR HYDRAULIC JACKING SYSTEM

(71) Applicants: KEPPEL OFFSHORE & MARINE TECHNOLOGY CENTRE PTE LTD, Singapore (SG); OFFSHORE TECHNOLOGY DEVELOPMENT PTE LTD, Singapore (SG)

(72) Inventors: Michael John Perry, Singapore (SG); Chin Kau Quah, Singapore (SG); Kok Seng Foo, Singapore (SG)

(73) Assignees: KEPPEL OFFSHORE & MARINE TECHNOLOGY CENTRE PTE LTD, Singapore (SG); OFFSHORE TECHNOLOGY DEVELOPMENT PTE LTD, Singapore (SG)

( * ) Notice: Subject to any disclaimer, the term of this patent is extended or adjusted under 35 U.S.C. 154(b) by 0 days.

(21) Appl. No.: 15/322,732

(22) PCT Filed: Aug. 31, 2015

(86) PCT No.: PCT/SG2015/050288
§ 371 (c)(1),
(2) Date: Dec. 29, 2016

(87) PCT Pub. No.: WO2017/039527
PCT Pub. Date: Mar. 9, 2017

(51) Int. Cl.
*B66F 7/20* (2006.01)
*E02B 17/04* (2006.01)
(Continued)

(52) U.S. Cl.
CPC ..... *B66F 7/20* (2013.01); *E02B 17/021* (2013.01); *E02B 17/06* (2013.01); *E02B 17/0872* (2013.01)

(58) Field of Classification Search
CPC ..... B66F 7/20; E02B 17/06; E02B 17/021; E02B 17/0872
See application file for complete search history.

(56) References Cited

U.S. PATENT DOCUMENTS 2,822,670 A * 2/1958 Suderow ..... E02B 17/0809 24/463
2,944,403 A 7/1960 Smith
(Continued)

FOREIGN PATENT DOCUMENTS

CN 104120700 A 10/2014
GB 779607 A 7/1957

OTHER PUBLICATIONS

International Search Report of International Application No. PCT/SG2015/050288 completed and dated Oct. 7, 2015 (5 pages).
(Continued)

*Primary Examiner* — Benjamin F Fiorello
(74) *Attorney, Agent, or Firm* — Pyprus Pte Ltd

(57) ABSTRACT

A self-elevating platform comprises a deck structure, a plurality of legs, a plurality of footings, and a jacking system, wherein the plurality of legs pass through the deck structure and are supported by the plurality of footings; and wherein the jacking system comprises a jackcase structure with a first locking pin, a jacking yoke with a second locking pin, a plurality of jacking cylinders with a first end and second end, where the first end of the jacking cylinders is supported by the jackcase structure, and the second end of the jacking cylinders by the jacking yoke; and a fixation system comprising a plurality of tension rods, wherein each tension rod has a first end and a second end, and wherein the first end of the tension rods is securely coupled with the jacking yoke, and the second end of the tension rods is securely coupled with the deck structure; thereby when the plurality of tension rods secures the jacking yoke to the deck
(Continued)

structure, the load can be removed from the hydraulic cylinders and transferred to the fixation system.

5 Claims, 6 Drawing Sheets

(51) Int. Cl.
*E02B 17/08* (2006.01)
*E02B 17/06* (2006.01)
*E02B 17/02* (2006.01)

(56) References Cited

U.S. PATENT DOCUMENTS 4,348,007 A * 9/1982 Malzacher ..... E21B 15/003 254/106
4,386,757 A * 6/1983 Vezole ..... E02B 17/0818 254/89 R
4,411,408 A * 10/1983 Radovan ..... E02B 17/021 254/108
4,655,640 A * 4/1987 Gillis ..... E02B 17/021 254/105
4,765,777 A * 8/1988 Gregory ..... E02D 35/00 254/29 R
4,832,315 A 5/1989 Vanderklaauw
6,038,823 A * 3/2000 Gallimore ..... E01F 1/005 52/126.1
2010/0215439 A1* 8/2010 Mikx ..... E02B 17/0872 405/198
2011/0211915 A1* 9/2011 Van Nood ..... E02B 17/0809 405/197
2018/0044872 A1* 2/2018 Deul ..... E02B 17/0836

OTHER PUBLICATIONS

Written Opinion of the International Searching Authority of International Application No. PCT/SG2015/050288 completed and dated Oct. 7, 2015 (5 pages).
Written Opinion of the International Preliminary Examining Authority of International Application No. PCT/SG2015/050288 dated Mar. 15, 2016 (5 pages).
International Preliminary Report on Patentability of International Application No. PCT/SG2015/050288 completed and dated Jun. 20, 2016 (12 pages).

* cited by examiner

FIXATION SYSTEM FOR HYDRAULIC JACKING SYSTEM

FIELD OF THE INVENTION

The present invention relates generally to an offshore self-elevating platform and more particularly to a fixation system for a hydraulic jacking system that can be employed in an offshore self-elevating platform.

BACKGROUND OF THE INVENTION

Offshore self-elevating platforms have been widely employed in offshore exploration and production for oil or gas, as well as in other offshore markets such as for offshore electrical stations, construction support and accommodations. The self-elevating platforms usually comprise a deck structure with a top platform for providing a working area and accommodating various working instruments, and a plurality of legs along which the deck structure can be jacked up or down.

Self-elevating platforms are preferred when offshore platforms need to be installed independently on site or to be moved to new locations from time to time. Self-elevating platforms may be used in many offshore industries such as oil and gas drilling or production, construction, accommodation and so on. Several different approaches may be used for providing the elevation means required for a self-elevating platform. Hydraulic jacking systems are commonly used in self-elevating platforms for lowering the legs from an afloat condition and for raising the hull out of the water. The hydraulic jacks can be arranged in many ways to achieve this. One such arrangement is illustrated in FIGS. 1 and 2.

FIG. 1 shows a basic arrangement of a self-elevating platform. In this arrangement, the self-elevating platform 1 comprises a deck structure 10, a plurality of legs 20, and a plurality of footings 30, where the plurality of legs 20 pass through the deck structure 10 and are supported by the plurality of footings 30. In order to provide the elevating means for raising and lowering the deck structure 10 relative to the legs 20, the self-elevating platform 1 is further equipped with a jacking system 40. When installed on site, the footings 30 provide support in a seabed S and the deck structure 10 is elevated above the water level W. The plurality of legs 20 have lifting points 21 to provide engagement means between the legs 20 and the jacking system 40. In this illustration the lifting points 21 are illustrated as holes through the leg, but these could also be provided by other means known in the industry. The platform may have three or more legs, and arrangements with three, four and six legs are common.

FIG. 2 shows a schematic view of the jacking system 40 of FIG. 1. The jacking system 40 is shown using a tubular leg 20 with pin holes 21 to engage the leg. The jacking system 40 comprises a jackcase structure 41 with a first locking pin 42, a jacking yoke 43 with a second locking pin 44, and a plurality of jacking cylinders 45 with a first end and second end, where the first end of the jacking cylinders 45 is supported by the jackcase structure 41, and the second end of the jacking cylinders 45 by the jacking yoke 43. The jacking system 40 operates in a push mechanism when raising the deck structure 10 out of the water and in a pull mechanism when retrieving the legs 20 to move to a new location. The first locking pin 42 holds the legs 20 when retracting the jacking cylinder, and the second locking pin 44 holds the legs 20 during jacking. In the position shown, the second locking pin 44 is engaged while the first locking pin 42 is disengaged. In this condition the weight of the deck structure 10 is carried by the hydraulic cylinders 45.

In FIG. 2, only one locking pin is visible at each elevation (at jackcase and at yoke) for simplicity of illustration. However, it is understood that several locking pins may be employed. Common systems will usually consist of two to four locking pins at each elevation, and in some cases a larger number of pins may be used Likewise, the number of jacking cylinders can vary. In most instances, either one or two cylinders are employed for each locking pin position used.

The jacking system 40 shown in FIG. 2 allows the deck structure 10 to be lifted as described below. In this description, the procedure is described using a single leg as shown in FIG. 2. The jacking systems 40 at multiple legs would be coordinated when lifting to ensure even elevation of the deck structure 10. Where differential leg positions occur, jacking would pause at each instance that any leg reaches a retraction position, so that the cylinders on the relevant leg can be retracted and the second locking pin is re-engaged before continuing with jacking on all legs.

Beginning with the arrangement shown in FIG. 2, the second locking pin 44 is engaged and the weight of the deck structure 10 is supported by the hydraulic cylinders 45. From this position, the hydraulic cylinders 45 would be extended until a lifting point 21 is aligned with the first locking pin 42. The first locking pin 42 can then be engaged and the load transferred to the first locking pin 42 such that the second locking pin 44 can be disengaged. With the second locking pin 44 disengaged, the hydraulic cylinders then retract the yoke 43 until the second locking pin 44 is aligned with a next lifting point 21. The second locking pin 44 is then engaged and the load transferred back to the hydraulic cylinders 45 before disengaging the first locking pin 42. The hydraulic cylinders 45 can then be extended to continue with the deck raising operation. This process is repeated until the desired deck elevation is reached.

Once the deck structure 10 has been elevated, there are two options to lock the deck structure 10 in position. If the seabed S is even and footings 30 have undergone equal penetration into the seabed S, the lifting points on each leg will be aligned, and the hull can be jacked up or down until a lifting point 21 is aligned with the first locking pin 42. The first locking pin 42 can then be used to lock the platform in place and the load in the hydraulic cylinders 45 can be removed. In many cases, however, the seabed S is uneven and/or footings 30 of the platform will undergo different amounts of penetration into the seabed S. In this case, the lifting points 21 on the legs 20 across multiple legs will not align at a single elevation and so it is not possible to use the fixed pins 42 to support the deck structure 10. In this case, the hydraulic cylinders 45 must continue to support the weight of the deck structure 10 while in place.

The second scenario described above may be acceptable for short term applications; however, in longer term applications, it is desirable to provide a more direct means of securing the leg-deck connection such that the hydraulic cylinders can be stored, and/or maintained, without needing to carry the weight of the deck structure 10.

SUMMARY OF THE INVENTION

The present invention provides a self-elevating platform. In one embodiment, the self-elevating platform comprises a deck structure, a plurality of legs, a plurality of footings, and a jacking system, wherein the plurality of legs pass through the deck structure and are supported by the plurality of footings; and wherein the jacking system comprises a jackcase structure with a first locking pin, a jacking yoke with a second locking pin, a plurality of jacking cylinders with a first end and second end, where the first end of the jacking cylinders is supported by the jackcase structure, and the second end of the jacking cylinders by the jacking yoke; and a fixation system comprising a plurality of tension rods, wherein each tension rod has a first end and a second end, and wherein the first end of the tension rods is securely coupled with the jacking yoke, and the second end of the tension rods is securely coupled with the deck structure; thereby when the plurality of tension rods secures the jacking yoke to the deck structure, the load can be removed from the hydraulic cylinders and transferred to the fixation system.

In another embodiment of the self-elevating platform, the first end of the tension rods is provided with a thread passing through an opening provided in the jacking yoke and secured using a first nut, and the second end of the tension rods is provided with a thread passing through an opening in the deck structure and secured using a second nut.

In another embodiment of the self-elevating platform, the first end of the tension rods is provided with a thread passing through an opening provided in the jacking yoke and secured using a first nut, and the second end of the tension rods is permanently fixed to the deck structure.

In another embodiment of the self-elevating platform, the first end of the tension rods is permanently fixed to the jacking yoke, and the second end of the tension rods is provided with a thread passing through an opening in the deck structure and secured using a second nut. In a further embodiment of the self-elevating platform, the hydraulic cylinders are repositioned to substantially align with the location of the tension rods.

The objectives and advantages of the claimed subject matter will become apparent from the following detailed description of preferred embodiments thereof in connection with the accompanying drawings.

BRIEF DESCRIPTION OF THE DRAWINGS

Preferred embodiments according to the present invention will now be described with reference to the Figures, in which like reference numerals denote like elements.

DETAILED DESCRIPTION OF THE INVENTION

The present invention may be understood more readily by reference to the following detailed description of certain embodiments of the invention.

Throughout this application, where publications are referenced, the disclosures of these publications are hereby incorporated by reference, in their entireties, into this application in order to more fully describe the state of art to which this invention pertains.

The present invention provides a fixation system for fixing the leg-deck structure connection for a self-elevating platform that utilizes a hydraulic jacking system. The fixation system comprises a plurality of adjustable tension rods that are so arranged to tie the jacking yoke to the deck in order to secure the yoke in position when the deck structure is elevated. In this way, a direct load path between the leg and deck structure is provided and the load can be released from the hydraulic cylinders in order for them to be maintained, or even removed for storage while the deck is elevated. This is desirable, particularly for cases where the platform is to remain at a single location for a period of several years.

Figure 1:
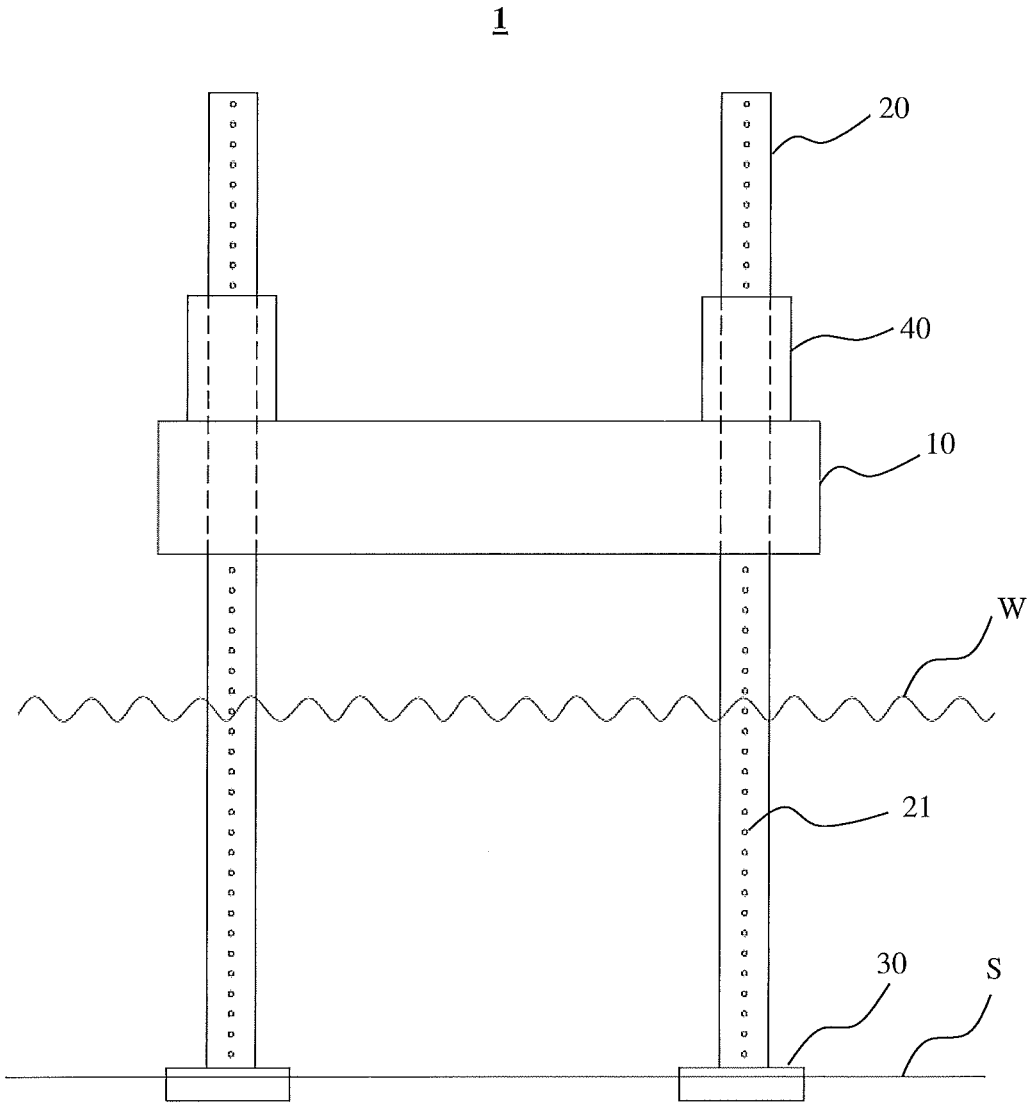
FIG 1 (Prior Art)
FIG. 1 shows a block diagram of the basic arrangement of a self-elevating platform in the prior art.
Figure 2:
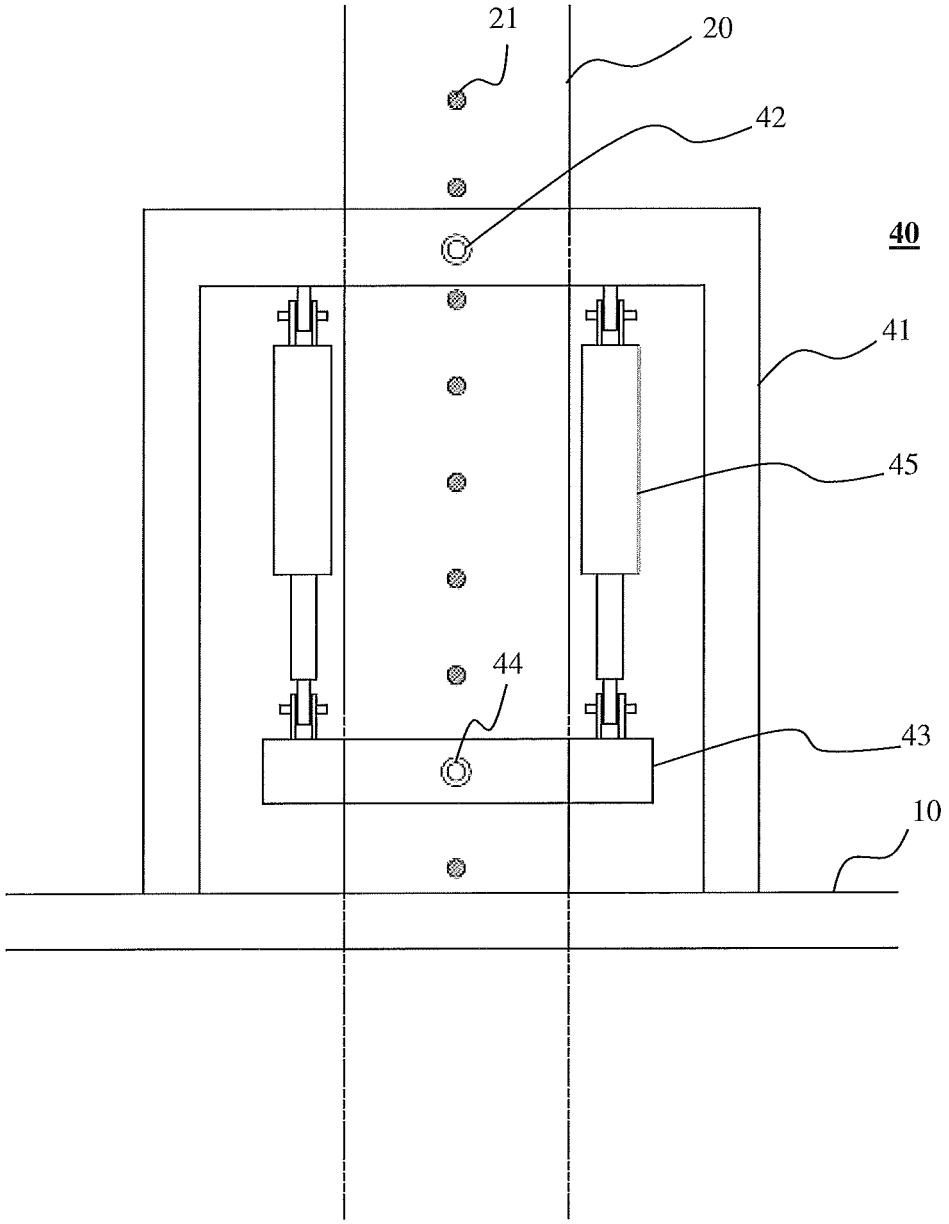
FIG 2 (Prior Art)
FIG. 2 shows a block diagram of the basic arrangement of a hydraulic jacking system in the prior art.
Figure 3:
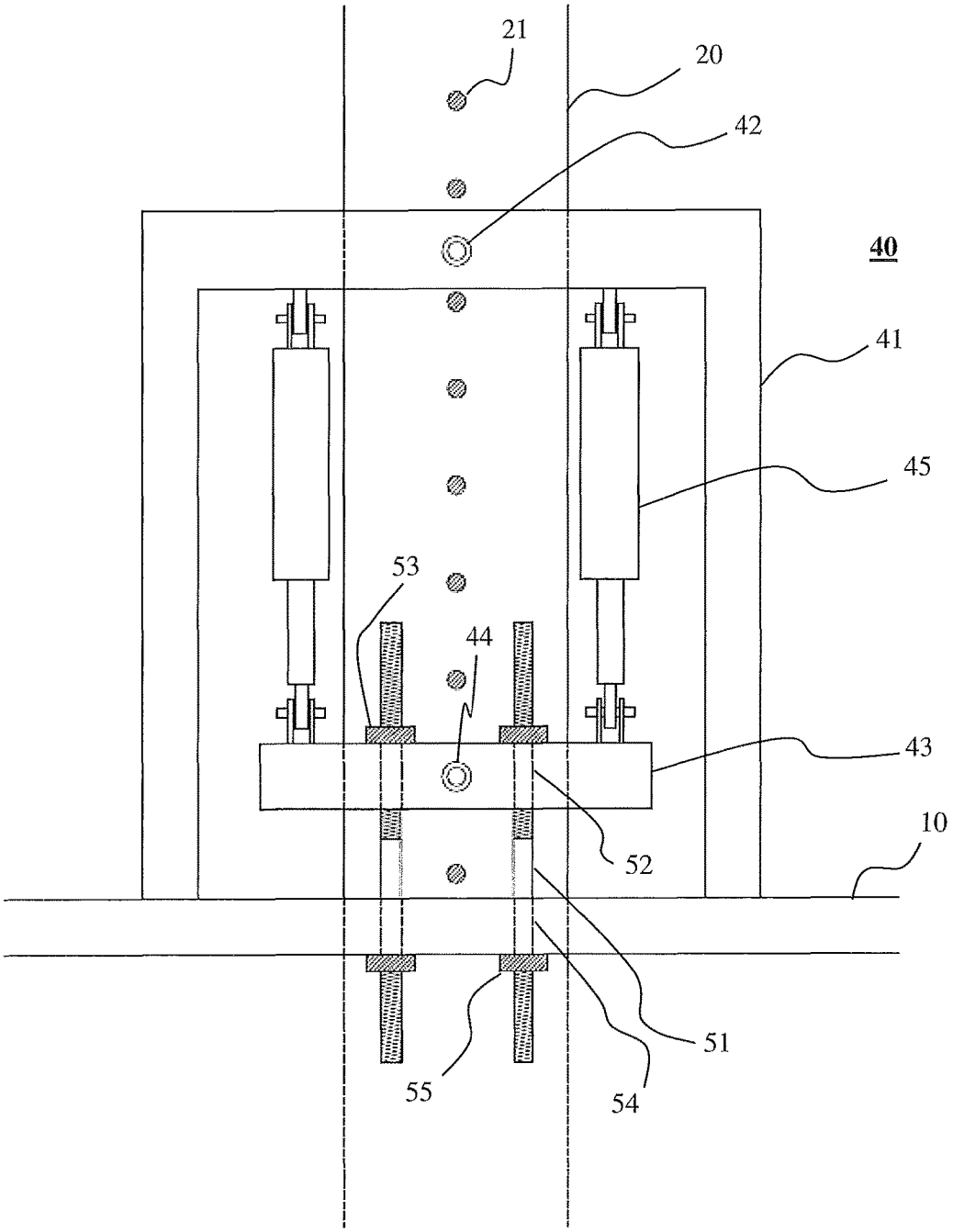
FIG. 3 shows a block diagram of a hydraulic jacking system comprising a fixation system in accordance with one embodiment of the present invention.

Referring now to FIG. 3, there is provided a fixation system in accordance with one embodiment of the present invention. As shown in FIG. 3, the jacking system 40 is similar to that shown in FIG. 2 except for the inclusion of a fixation system. The fixation system comprises a plurality of tension rods 51 securing the jacking yoke 43 to the deck structure 10, where each tension rod 51 has a first end and a second end. The first end of the tension rods 51 is provided with a thread passing through an opening 52 provided in the jacking yoke 43 and secured using a first nut 53, and the second end of the tension rods 51 is provided with a thread passing through an opening 54 in the deck structure 10 and secured using a second nut 55. The tension rods 51 are provided with a sufficient length of thread such that various positions of the jacking yoke 43 can be accommodated. In general, the yoke position is allowed to vary by a distance at least equal to the distance between the lifting points 21, thus allowing adjustment to any final leg position.

The fixation system shown in FIG. 3 is able to be operated in the following way. During jacking operations, the tension rod 51, the first nut 53, and the second nut 55 can be removed and jacking can proceed as described in the description of FIG. 2. When the hull reaches its final elevation, with the second locking pin 44 engaged, the tension rod 51, the first nut 53, and the second nut 55 can be moved into the position shown in FIG. 3, for example by inserting the tension rod 51 through the decks structure 10 and the jacking yoke 43, and then securing the tension rod 51 in position using the first and second nuts 53, 55. Once the tension rods 51 and nuts 53, 55 are in position and sufficiently tightened to avoid slack, the load can be removed from the hydraulic cylinders 45 and transferred to the fixation system.

Figure 4:
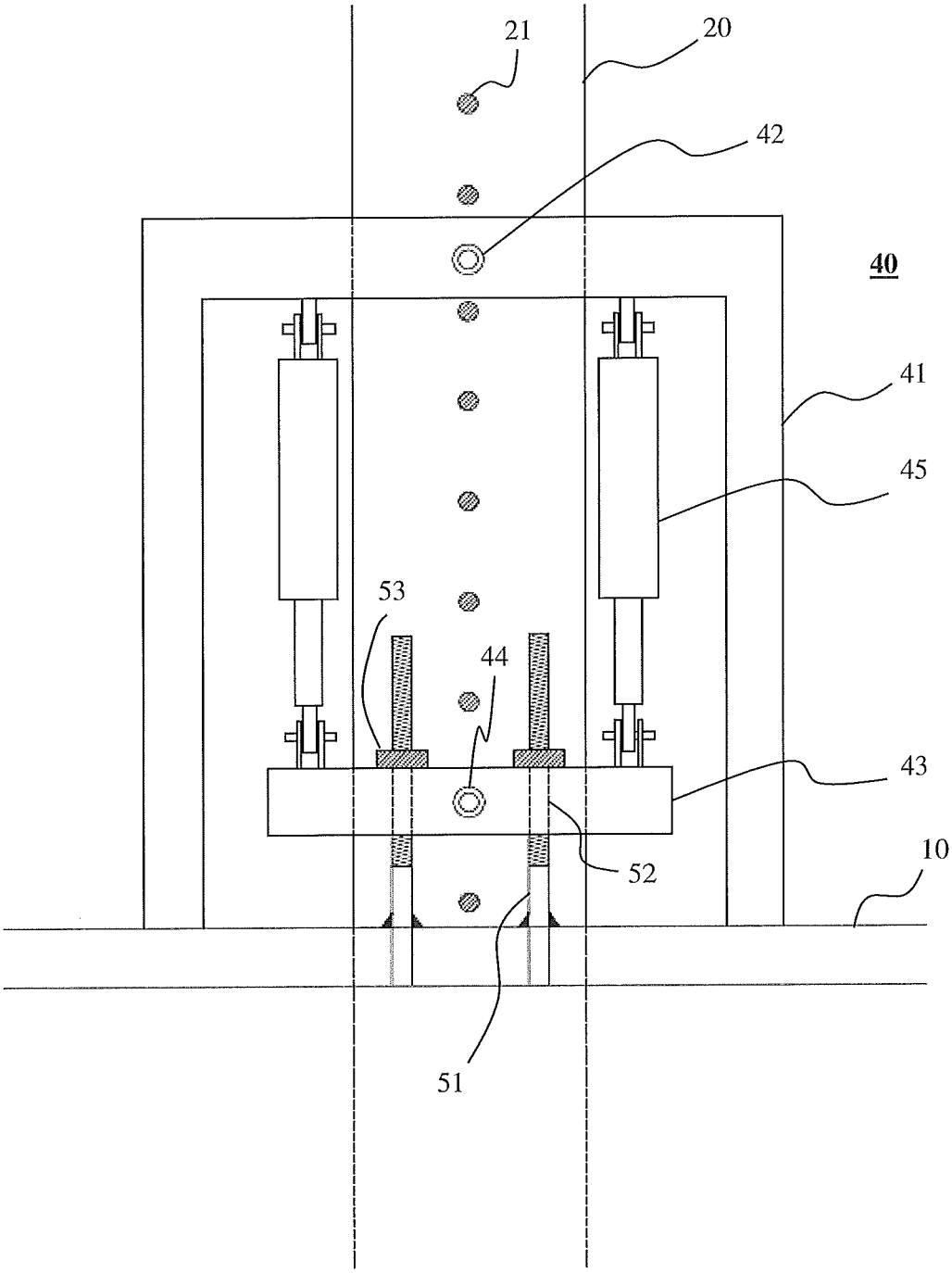
FIG. 4 shows a block diagram of a hydraulic jacking system comprising a fixation system in accordance with another embodiment of the present invention.

Referring now to FIG. 4, there is provided a fixation system in accordance with another embodiment of the present invention. The fixation system shown in FIG. 4 is similar to the fixation system shown in FIG. 3 except that the second end of the tension rods 51 is permanently fixed to the deck structure 10 for example by welding. In this embodiment, jacking is carried out with the tension rods 51 in position, but with the nuts 53 removed, or moved to a higher position on the thread whereby it does not interfere with the movement of the jacking yoke 43. This embodiment is convenient as it removes the need to lift the tension rods 51 into position and also removes the need to secure the second end of the tension rods 51 on location. The nut 53 can also be stored on the thread during jacking as long as it is moved to a location beyond the range of motion of the jacking yoke 43, which removes the need to lift the nut 53 into position.

Figure 5:
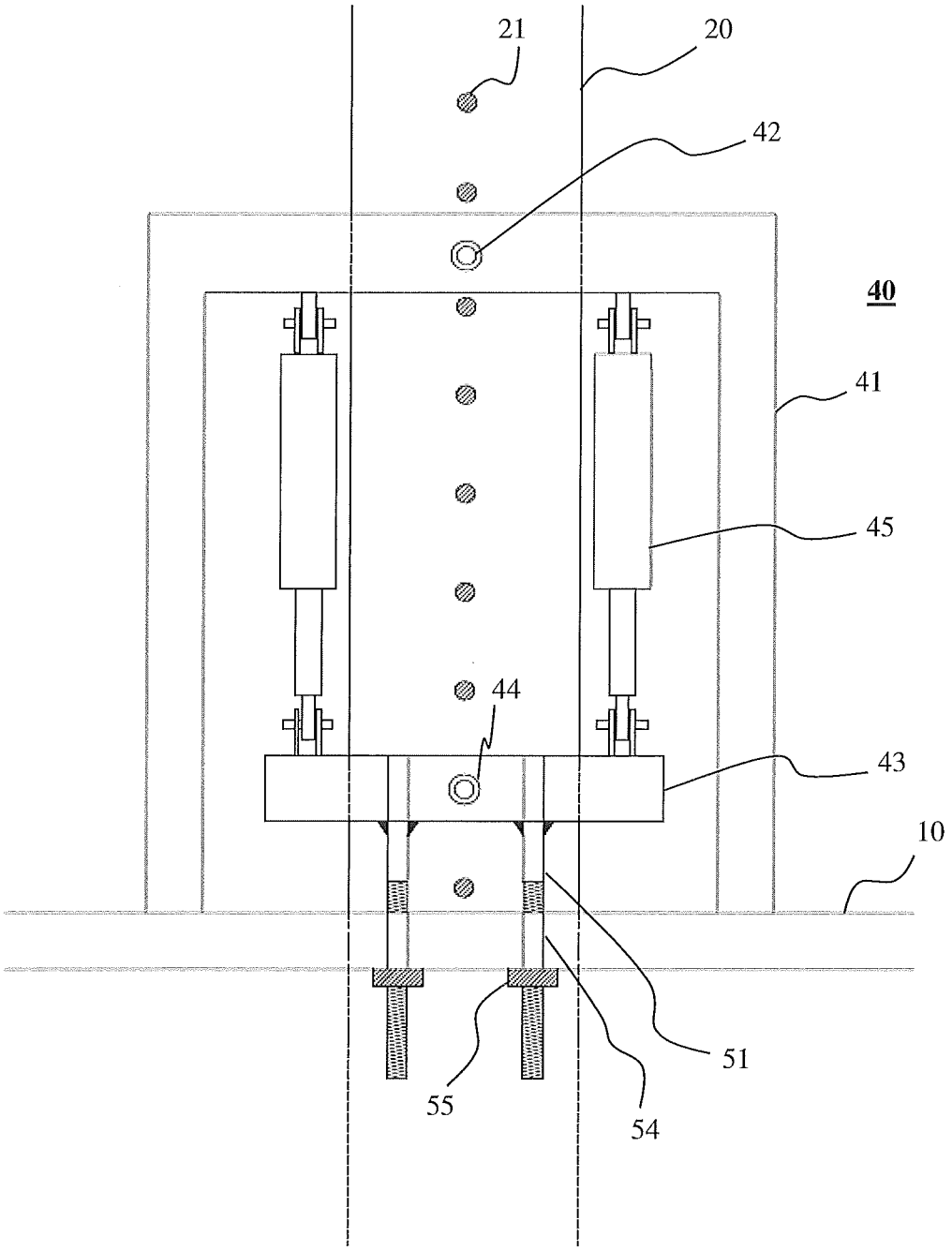
FIG. 5 shows a block diagram of a hydraulic jacking system comprising a fixation system in accordance with yet another embodiment of the present invention.

Referring now to FIG. 5, there is provided a fixation system in accordance with yet another embodiment of the present invention. The fixation system shown in FIG. 5 is similar to the fixation system shown in FIG. 3 except that the first end of the tension rods 51 is permanently fixed to the jacking yoke 43 for example by welding. In this embodiment, jacking is carried out with the tension rods 51 in position, but with the nut 55 removed, or removed to a location on the thread whereby it does not come into contact with the deck structure 10 with the movement of the jacking yoke 43. This embodiment is convenient as it removes the need to lift the tension rods 51 into position and also removes the need to secure the first end of the tension rods 51 on location. The nut 55 can also be stored on the thread during jacking as long as it is moved to a location which avoids contact with the deck structure 10 taking into account the range of motion of the jacking yoke 43. This removes the need to lift the nut 55 into position. In contrast to the embodiment shown in FIG. 4, this embodiment enables the nut 55 to be mounted under the deck structure 10, where it can be better protected from the environment.

Figure 6:
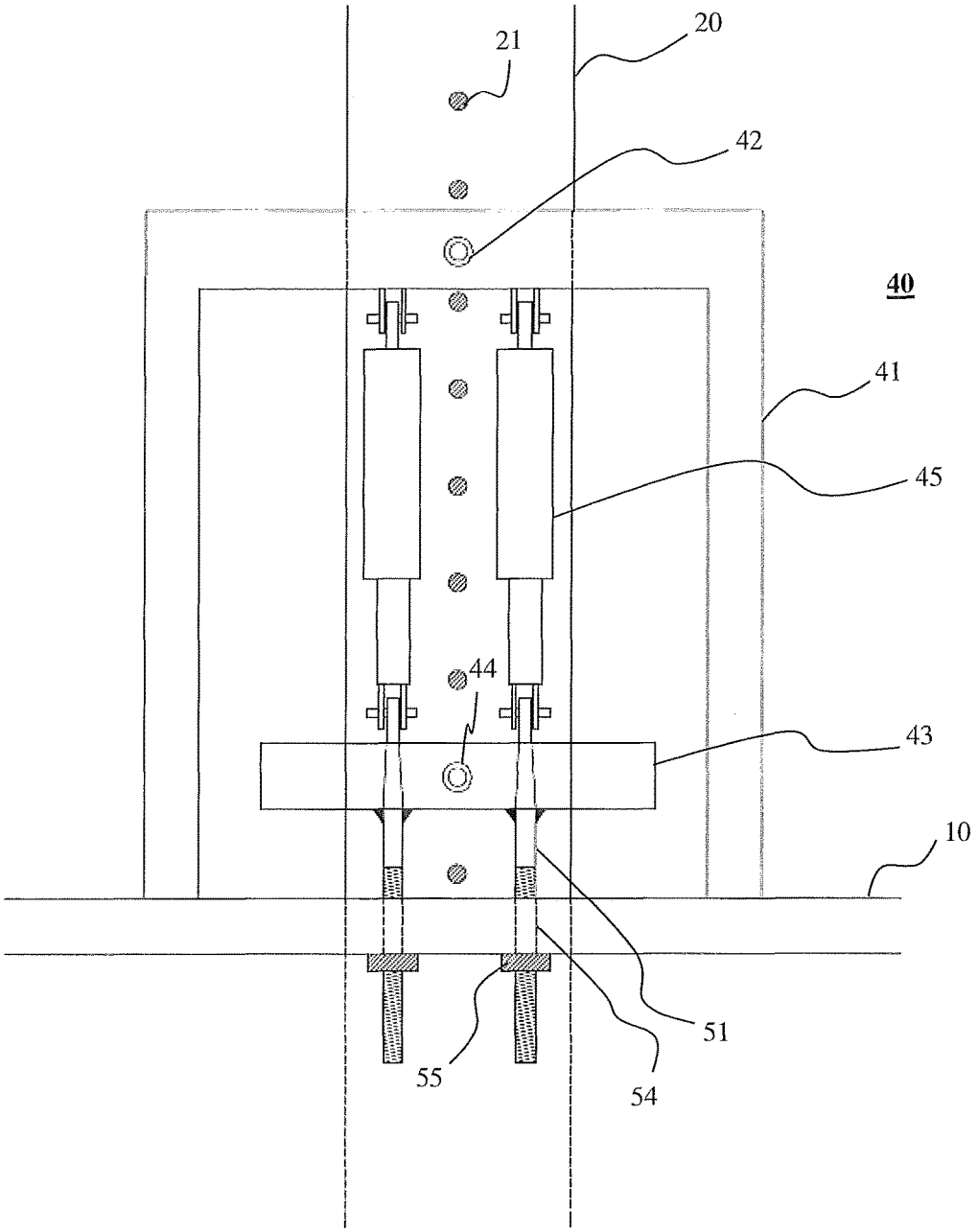
FIG. 6 shows a block diagram of a hydraulic jacking system comprising a fixation system in accordance with another embodiment of the present invention.

Referring now to FIG. 6, there is provided a fixation system in accordance with another embodiment of the present invention. The fixation system shown in FIG. 6 is similar to the fixation system shown in FIG. 5 except that the hydraulic cylinders 45 are repositioned to substantially align with the location of the tension rods 51. In this embodiment, the first end of the tension rods 51 is permanently fixed to the jacking yoke 43 for example by welding. In this embodiment, jacking is carried out with the tension rods 51 in position, but the nut 55 removed, or removed to a location on the thread whereby it does not come into contact with the deck structure 10 with the movement of the jacking yoke 43. As in the case of the fixation system shown in FIG. 5, this embodiment is convenient as it removes the need to lift the tension rods into position and also removes the need to secure the first end of the tension rods 51 on location. The nuts 55 can also be stored on the thread during jacking as long as it is moved to a location which avoids contact with the deck structure 10 taking into account the range of motion of the jacking yoke 43. This removes the need to lift the nut 55 into position. In addition, the alignment of the hydraulic cylinders 45 and tension rods 51 enable more efficient design of the jacking yoke structure as the lifting and fixation locations can be arranged more favorably. It also allows for a more compact design as the hydraulic cylinders 45 and tension rods 51 occupy the same horizontal space on the yoke 43, removing the need for these to be spread out. This allows the system to be used on smaller diameter legs, and allows a greater number of lifting points to be accommodated if required.

There is a large range over which the present invention could be used; the parameters will vary however depending on the type of platform, water depth, etc. The following exemplary parameters are provided for the sole purpose of illustrating the application of the present invention.

Leg diameter—preferably to be 1.5 m to 5 m, with common size of about 3.5 m.

Hydraulic cylinders—preferably to have lifting capacity of 200 to 800 metric tonnes (MT), with common capacity of about 500 MT.

Pin hole diameter—preferably range of 200 mm to 600 mm, with common size of about 350 mm.

Pin hole spacing—preferably to be 0.6 m to 2.5 m, with common size of about 1.5 m.

Jacking yoke—will be sized according to leg diameter and the load required.

Tension rods—preferably to be steel bars, with diameter of 60 mm to 250 mm.

Length of tension rods will be based on, pin hole spacing and the dimension of the yoke and main deck structures to make sure it is long enough.

While preferred embodiments of the present subject matter have been described, it is to be understood that the embodiments described are illustrative only and that the scope of the invention is to be defined solely by the appended claims when accorded a full range of equivalence, many variations and modifications naturally occurring to those of skill in the art from a perusal hereof.

What is claimed is:

1. A self-elevating platform comprising:

a deck structure;

a plurality of legs having a plurality of evenly spaced pin holes;

a plurality of footings; and a plurality of jacking systems, wherein one jacking system is disposed with one leg;

wherein the plurality of legs pass through the deck structure and are supported by the plurality of footings; and wherein the jacking system comprises:

a jackcase structure with a first removable locking pin, wherein the jackcase structure is fixed onto the deck structure;

a jacking yoke with a second removable locking pin;

a plurality of jacking cylinders with a first end and second end, where the first end of the jacking cylinders is supported by the jackcase structure, and the second end of the jacking cylinders by the jacking yoke;

wherein during retraction of a jacking process, the first removable locking pin is engaged with the jackcase structure so that load path is directly from the plurality of legs to the first removable locking pin and then to the jackcase structure; and wherein during pushing of the jacking process, the second removable locking pin is engaged with the jacking yoke so that the load path is from the plurality of legs, through the second removable locking pin, to the jacking yoke, through the plurality of jacking cylinders and then into the jackcase structure;

and a fixation system comprising a plurality of tension rods, wherein each tension rod has a first end and a second end, and wherein the first end of the tension rods is capable of being securely coupled with the jacking yoke, and the second end of the tension rods is capable of being securely coupled with the deck structure;

thereby when the jacking process is stopped and the second removable locking pin is still engaged with the jacking yoke, and the plurality of tension rods secures the jacking yoke to the deck structure, the load path is from the plurality of legs, through the second removable locking pin, to the jacking yoke, through the plurality of tension rods, and then into the deck structure.

2. The self-elevating platform of claim 1, wherein the first end of the tension rods is provided with a thread passing through an opening provided in the jacking yoke and secured using a first nut, and the second end of the tension rods is provided with a thread passing through an opening in the deck structure and secured using a second nut.

3. The self-elevating platform of claim 1, wherein the first end of the tension rods is provided with a thread passing through an opening provided in the jacking yoke and secured using a first nut, and the second end of the tension rods is permanently fixed to the deck structure.

4. The self-elevating platform of claim 1, wherein the first end of the tension rods is permanently fixed to the jacking yoke, and the second end of the tension rods is provided with a thread passing through an opening in the deck structure and secured using a second nut.

5. The self-elevating platform of claim 4, wherein the hydraulic cylinders are positioned to substantially align with the location of the tension rods.

* * * * *